US008529379B1

(12) United States Patent
Faircloth

(10) Patent No.: US 8,529,379 B1
(45) Date of Patent: Sep. 10, 2013

(54) GOLF BALL AND TEE SETTING AND RETRIEVING DEVICE

(76) Inventor: Timothy Faircloth, Pensacola, FL (US)

( * ) Notice: Subject to any disclaimer, the term of this patent is extended or adjusted under 35 U.S.C. 154(b) by 99 days.

(21) Appl. No.: 13/373,700

(22) Filed: Nov. 28, 2011

(51) Int. Cl.
*A63B 57/00* (2006.01)
*B25J 1/00* (2006.01)

(52) U.S. Cl.
USPC ..... 473/386; 294/19.2

(58) Field of Classification Search
USPC ..... 473/386, 132, 286; 294/19.1, 19.2, 294/87.1, 87.22, 99.1, 209
See application file for complete search history.

(56) References Cited

U.S. PATENT DOCUMENTS

| | | | | | |
|---|---|---|---|---|---|
| 2,609,198 | A | | 9/1952 | Armstrong | |
| 2,834,629 | A | | 5/1958 | Williams | |
| 3,527,492 | A | * | 9/1970 | Hollis | 294/115 |
| 3,669,427 | A | | 6/1972 | Curtis | |
| 4,466,650 | A | | 8/1984 | Roedel | |
| 4,616,826 | A | * | 10/1986 | Trefts | 473/133 |
| 4,714,250 | A | | 12/1987 | Henthorn | |
| 4,819,938 | A | | 4/1989 | Hill | |
| 4,949,961 | A | | 8/1990 | Milano | |
| 4,962,957 | A | * | 10/1990 | Traber | 294/100 |
| 5,205,598 | A | * | 4/1993 | Miller | 294/19.2 |
| 5,458,385 | A | * | 10/1995 | Peeples | 294/100 |
| 5,503,394 | A | | 4/1996 | Mauck et al. | |
| 5,577,785 | A | * | 11/1996 | Traber et al. | 294/100 |
| 5,669,646 | A | * | 9/1997 | Fiocca et al. | 294/24 |
| 5,672,121 | A | | 9/1997 | Miller | |
| 5,707,303 | A | * | 1/1998 | Berkowitz et al. | 473/386 |
| 5,772,533 | A | | 6/1998 | Dahlmann | |
| 5,839,972 | A | | 11/1998 | Swanson | |
| 6,394,515 | B1 | | 5/2002 | Keleher et al. | |
| 6,672,977 | B1 | * | 1/2004 | Colbo et al. | 473/386 |
| 6,848,731 | B2 | * | 2/2005 | Khubani et al. | 294/209 |
| 6,874,833 | B2 | * | 4/2005 | Keith et al. | 294/209 |
| 7,261,349 | B1 | * | 8/2007 | Gregor | 294/209 |
| 7,713,136 | B1 | | 5/2010 | Colucci | |
| 7,854,664 | B1 | * | 12/2010 | Comrie | 473/282 |
| 7,963,854 | B2 | * | 6/2011 | Nugent et al. | 473/137 |
| 2003/0203772 | A1 | * | 10/2003 | Paine | 473/386 |
| 2007/0021239 | A1 | * | 1/2007 | Gates | 473/386 |
| 2008/0146367 | A1 | * | 6/2008 | Cruz | 473/286 |

* cited by examiner

*Primary Examiner* — Steven Wong
(74) *Attorney, Agent, or Firm* — Peter Loffler

(57) ABSTRACT

A grabbing system uses a typical first grabber located on a main shaft to grasp golf tees for setting into and retrieving them from the ground. A secondary shaft slidably passes through the main shaft of the device and has a second grabber such that the first grabber and the second grabber are simultaneously controlled by a single trigger mechanism. This allows a tee and ball to be grasped and released together such that setting the position of the secondary shaft with respect to the main shaft allows for precise penetration placement of the tee into the ground. A clipping system allow for easy carrying of the device, while optional support legs allow the device to free stand upright on the ground.

12 Claims, 4 Drawing Sheets

GOLF BALL AND TEE SETTING AND RETRIEVING DEVICE

BACKGROUND OF THE INVENTION

1. Field of the Invention

The present invention relates to a handheld device that allows a golfer to place a tee into the ground and set a golf ball onto the tee, all at a desired height above the ground, and once the ball is hit, to retrieve the tee, all from a standing position as well as to retrieve a ball on the ground. The device allows a golfer the ability to play a round of golf without the need to bend over.

2. Background of the Prior Art

The game of golf is a timeless game that is played by the young and the young at heart. Unlike more vigorous sports, such as basketball, soccer, or tennis, peak physical shape is not a prerequisite for playing a solid round of golf. Although golf can be played throughout one's life, even during one's later years as a person's health declines, certain aspects of the game can make playing a round of golf difficult and much less fun.

During the start of each hole, the ball is teed up and driven toward the pin. The golfer bends over and inserts the tee into the ground at a desired depth of insertion, places the ball onto the tee, and hopefully shoots a beauty straight down the middle of the fairway. Thereafter, the tee, or at least what's left, is retrieved and the game continues. Additionally, after the ball is sunk, the ball is retrieved from the cup and the golfer proceeds to the next hole. While these before and after round functions are routine for most golfers, they can be unbearably painful if not outright impossible for golfers who have certain ailments. A golfer with bad hips, knees, or back, due to such causes as arthritis, injury, or simple old age, may be able to hit the ball with reasonable force, yet be unable to bend down to tee up the ball or to retrieve the tee or the ball from the cup, without serious discomfort, to the point that the round of golf may be more trouble than enjoyment.

Some golfers overcome such limitations by hiring a caddy for a round of golf and rely on the caddy to perform any tasks that require bending over. However, not only are caddies expensive, very few courses maintain a stable of caddies. Some golfers rely on other members in the golfer's party to perform the tasks that that ailing golfer cannot easily perform. However, such reliance can be quite embarrassing for the affected golfer, and is not a solution for a golfer playing a solo round or for a golfer practicing on the driving range.

To address the problem of a golfer's difficulty in bending down to tee up and retrieve balls, devices have been proposed that allow a golfer to set a tee and place a ball onto the tee and retrieve each as needed, all from a standing position. Many modern interpretations of such devices rely on a "grabber arm" architecture wherein two or more grabber fingers at a distal end of the device are opened and closed via a golfer controlled handle located at the proximal end of the device. The ball or tee or both are grabbed by the fingers of the grabber arm and are positioned as needed. While such devices allow a golfer with certain physical limitation to enjoy a game of golf, such devices are not without their drawbacks.

Many such devices, while effective, are unduly complex in design so that manufacture of such device is relatively expensive, thereby narrowing the potential consumer market for such devices. Some devices are awkward to control so that grasping of the generally spherical ball can be tricky. Additionally, the prior art devices do not allow precision of the depth of tee insertion into the ground per the golfer's desired depth. While the tee can be eventually manipulated to the approximate desired height, such manipulation is awkward.

What is needed is a device that allows a golfer to be able to insert a tee into the ground at a desired depth of insertion and place a golf ball onto the tee for hitting, with the device allowing retrieval of the tee and ball as needed. Such a device must be of relatively simple design so as to be relatively inexpensive to produce so as to be affordable for a large segment of consumer market for such devices. Such a device must be easy to operate so that grasping of the spherical ball is quick and easy without undue drops or slips.

SUMMARY OF THE INVENTION

The golf ball and tee setting and retrieving device of the present invention addresses the aforementioned needs in the art by providing a device that allows a golfer, from a standing position, to be able to quickly and accurately set a tee into the ground at the desired depth of tee insertion and position a ball onto the tee. The golf ball and tee setting and retrieving device also allows the golfer to retrieve the tee and ball as need, also from the standing position. The golf ball and tee setting and retrieving device is of relatively simple design and construction, produced using standard manufacturing techniques, so as to make the device relatively inexpensive to obtain and maintain. The golf ball and tee setting and retrieving device is sure of grip so that the ball can be grasped by the device with relative ease so as to allow ball manipulation using the device to be relatively quick and easy.

The golf ball and tee setting and retrieving device of the present invention is comprised of a hollow main shaft that has a first proximal end and a first distal end. A first grabber arm is located on the main shaft proximate the first distal end such that the first grabber arm has a pair (or more) of first fingers pivotally attached to the main shaft proximate the first distal end and capable of being opened and closed. A secondary shaft is slidably disposed within the main shaft. The secondary shaft has a second proximal end that extends outwardly from the first proximal end of the main shaft and also has a second distal end that extends outwardly from the first distal end of the main shaft. A second grabber arm is located on the secondary shaft proximate the second distal end such that the second grabber arm has a pair (or more) of second fingers (acting as a ball basket) pivotally attached to the secondary shaft proximate the second distal end which second grabber arm is capable of releasably holding a golf ball. A trigger mechanism is attached to the main shaft and simultaneously controls the opening of the first fingers of the first grabber arm and the second fingers of the second grabber arm. At least one visual aid marking is located on the secondary shaft proximate the second proximal end. A cap is located on the second proximal end of the secondary shaft and is used both as a handle and a stop. A lock is provided and locks the secondary shaft in a fixed position with respect to the main shaft. A clipping system has a main body that encircles the main shaft, a closed loop clip with a spring loaded jaw extending from a first side of the main body and a scissors clip extending from an opposing second side of the main body. An optional pair of support legs is pivotally attached to the main shaft.

BRIEF DESCRIPTION OF THE DRAWINGS

Similar reference numerals refer to similar parts throughout the several views of the drawings.

DESCRIPTION OF THE PREFERRED EMBODIMENT

Figure 1:
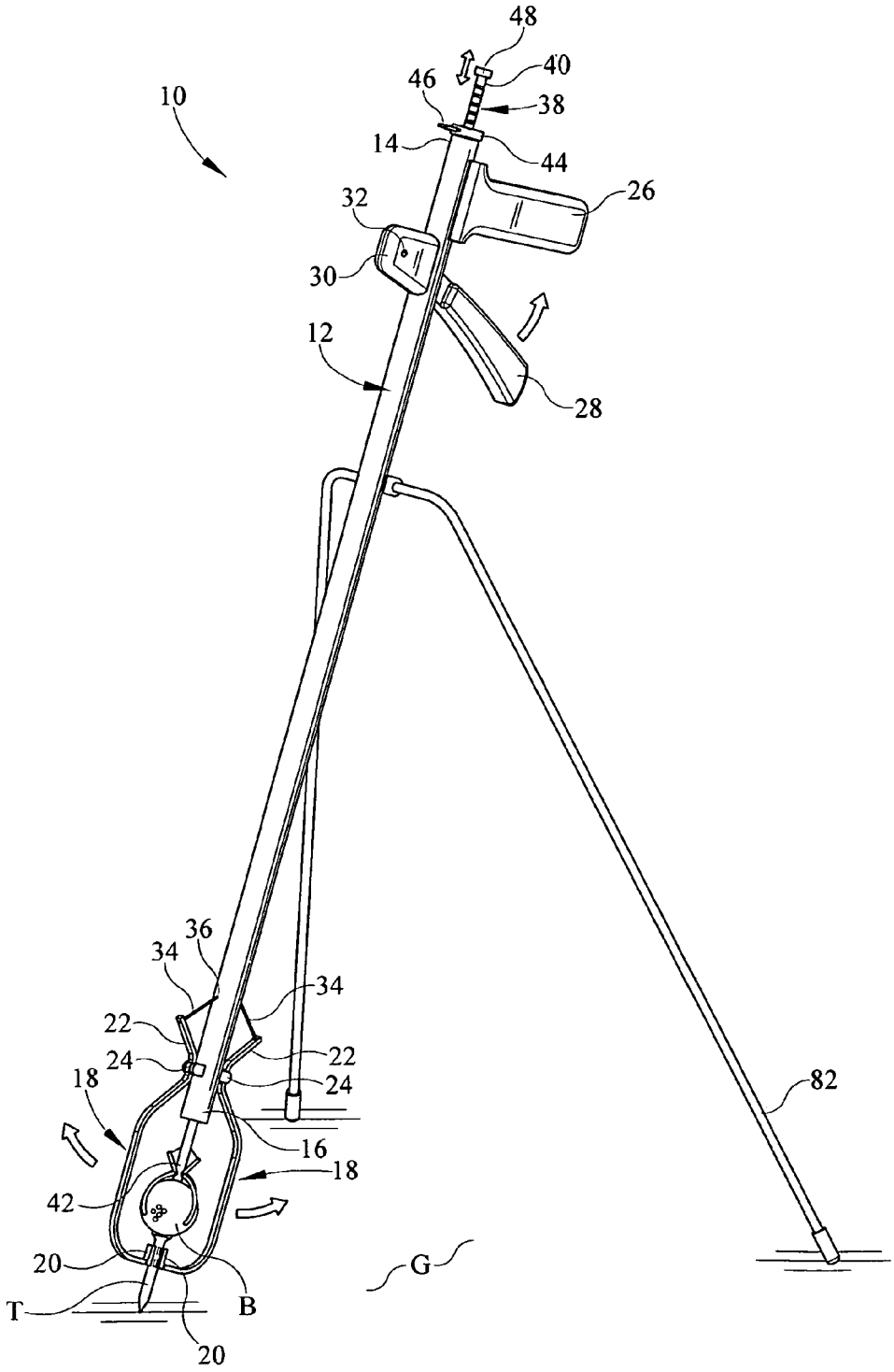
FIG. 1 is a perspective view of the golf ball and tee setting and retrieving device of the present invention.
Figure 2:
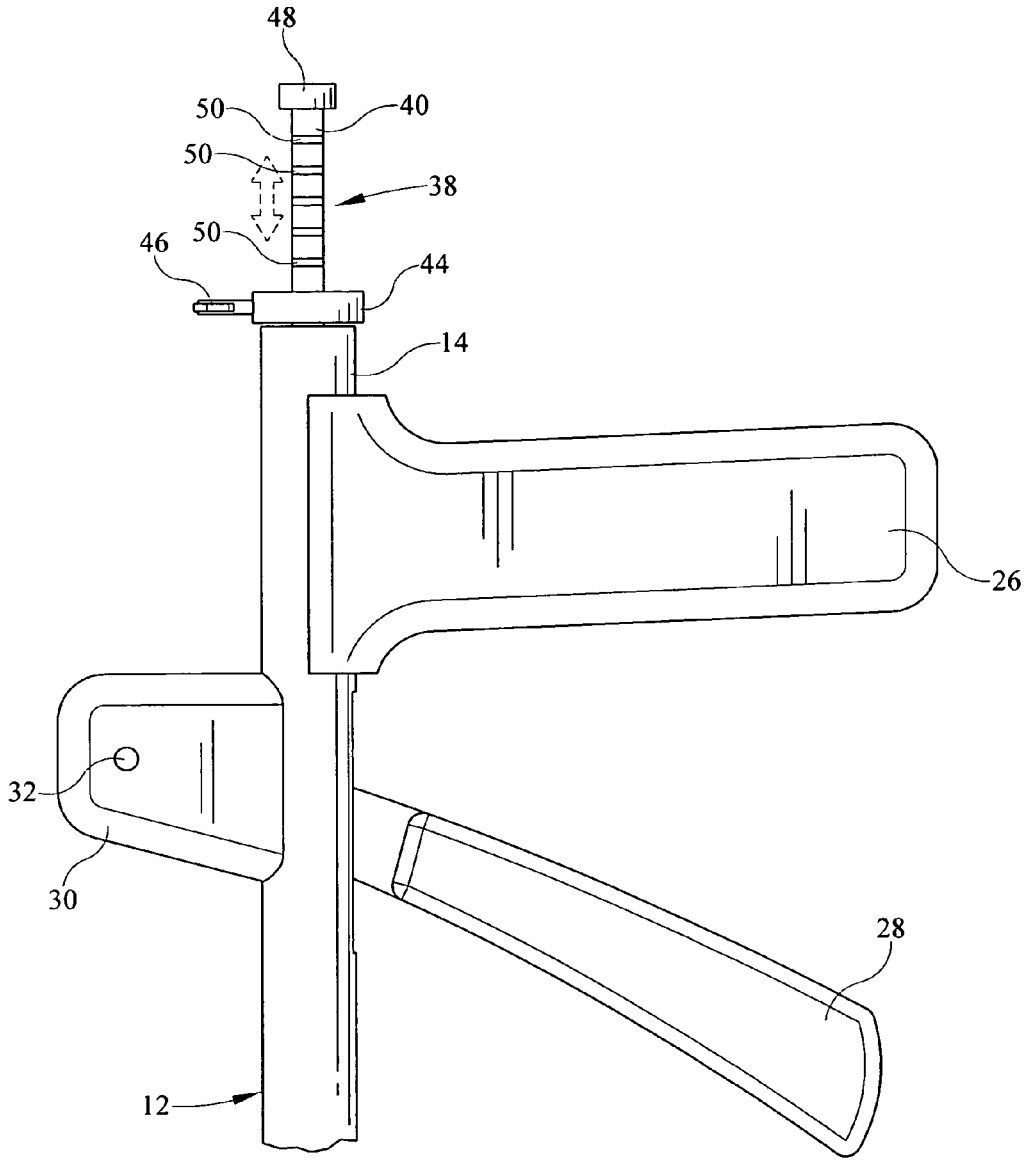
FIG. 2 is an elevation view of the proximal end of the golf ball and tee setting and retrieving device.
Figure 3:
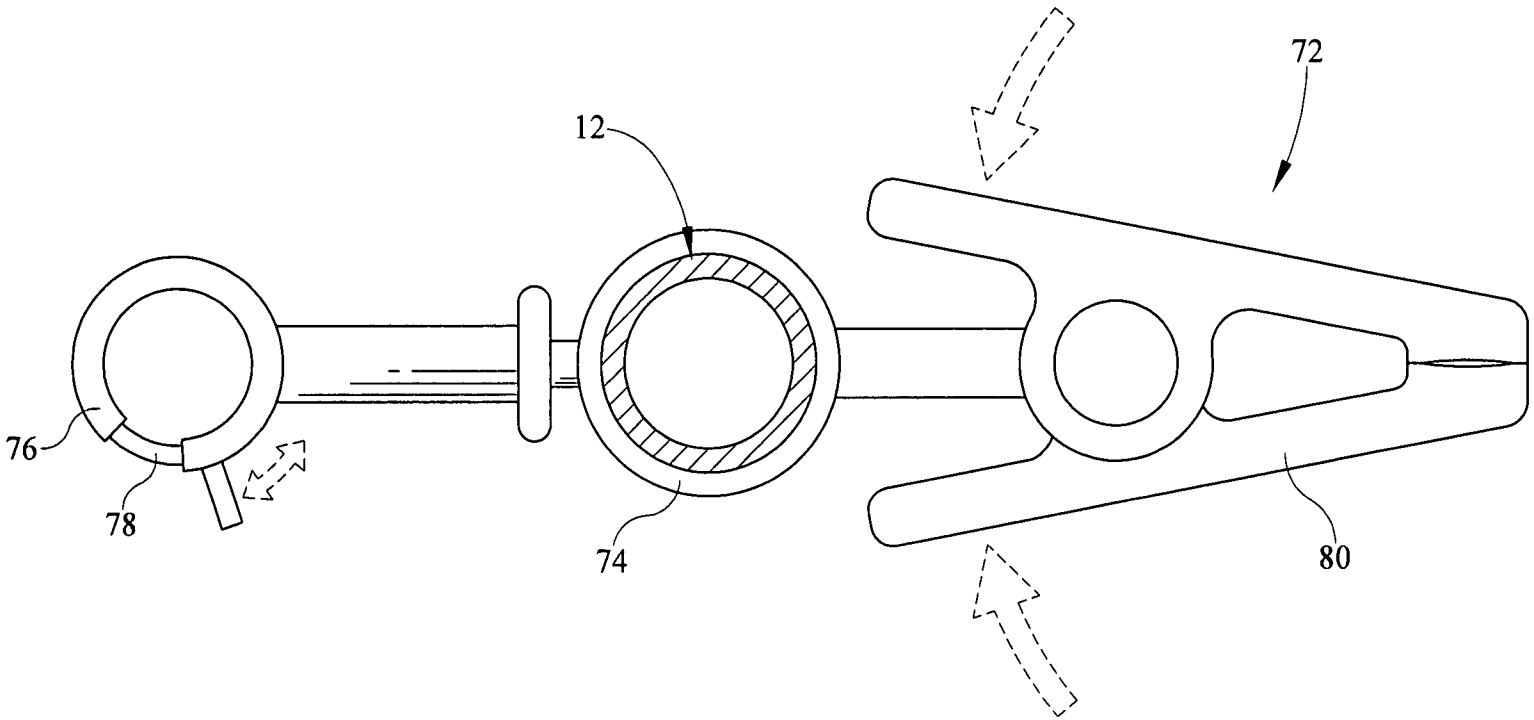
FIG. 3 is a plan view, partially sectioned, illustrating the clip used with the golf ball and tee setting and retrieving device.
Figure 4:
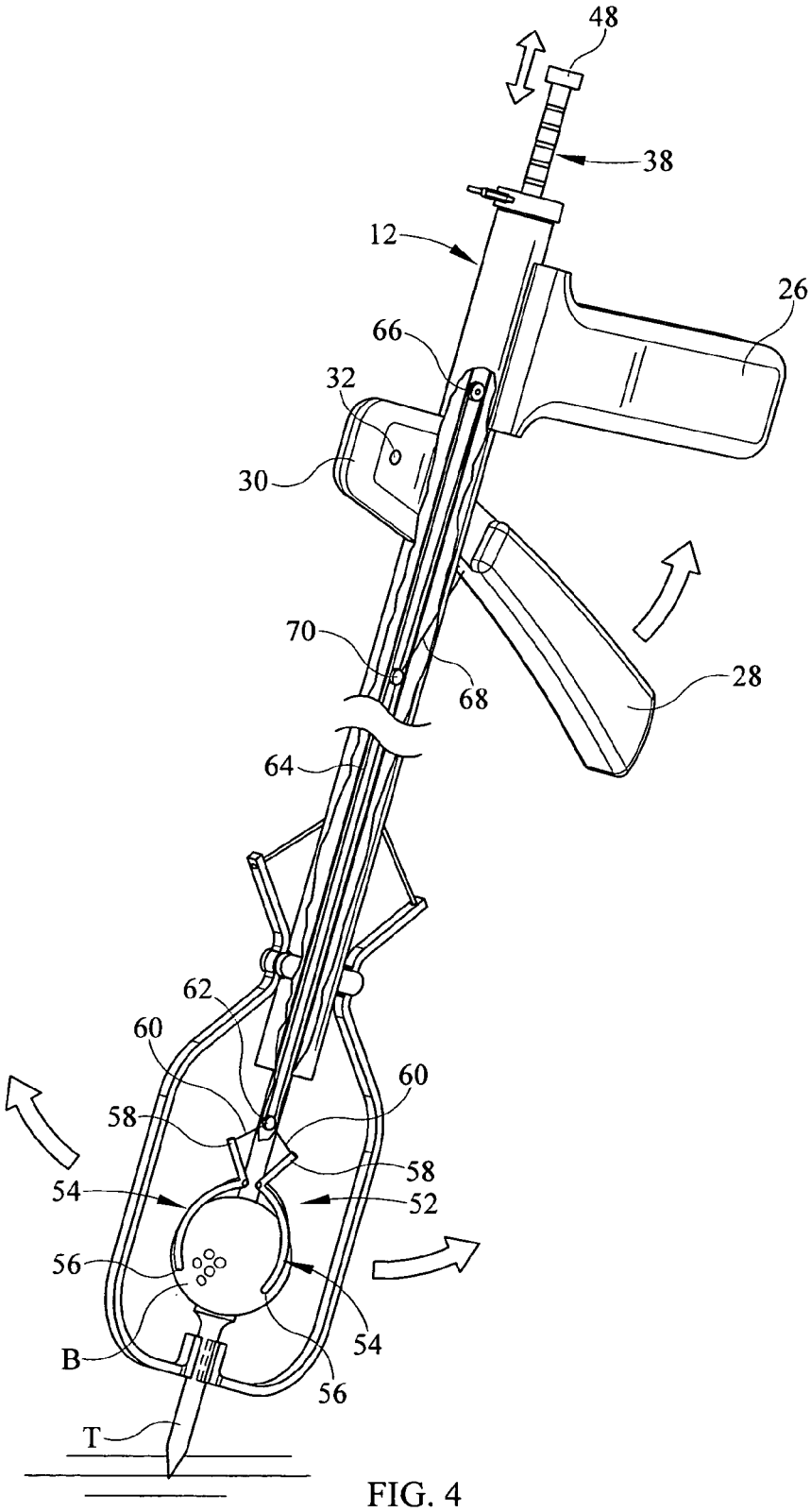
FIG. 4 is a perspective view, partially cut away, of the golf ball and tee setting and retrieving device holding a tee and a golf ball.

Referring now to the drawings, it is seen that the golf ball and tee setting and retrieving device of the present invention, generally denoted by reference numeral 10, is comprised of a generally hollow main shaft 12, having a proximal end 14 and a distal end 16. An outer or first grabber has two or more first fingers 18 that are pivotally attached to the main shaft 12 proximate the distal end 16. Each of the first fingers 18 has apposing first ends 20 and second ends 22, such that the pivotal point of attachment 24 of the first fingers 18 to the main shaft 12 is between first end 20 and the second end 22 of each first finger 18, but closer to the second end 22. As seen in FIG. 1, each first finger 18 extends diagonally outwardly from the pivot point of attachment 24 to the second end 22. The first end 20 of each first finger 18 are curled upwardly and may be slotted so as to be able to firmly grab the shaft of a golf tee T, whenever the fingers 18 are brought together. If desired, each pivot point of attachment 24 may be spring loaded so as to normally bias the first ends 20 of the first fingers 18 together.

A handle 26 is located on the proximal 14 end of the main shaft 12 while a trigger 28 is pivotally attached to either directly to a point on the main shaft 12, or as seen, to a pivot housing 30 located on the main shaft 12 opposite the trigger 28, the trigger 28 passing through the main shaft 12 with a pin 32 pivotally attaching the trigger 28 to the housing 30. The pivotal attachment of the trigger 28 to the main shaft 12 or the pivot housing 30 can be spring loaded which spring loading may be in addition to or in lieu of the spring loaded pivotal attachment of the fingers 18 to the main shaft 12. A first cable 34, which can be string, filament, metal, etc., is attached to the trigger 28 and also to the second end 22 of each finger 18, one cable 34 per first finger 18 (or a single cable that branches to each finger 18), the first cable 34 passing through the interior of the main shaft 12 and exiting out from the main shaft 12 through appropriate openings 36 located proximate the second end 22 of each finger 18. Whenever the trigger 28 is squeezed toward the handle 26, the backwardly traveling (toward the proximal end 14 of the main shaft) trigger 28 pulls on the first cables 34 causing them to partially retract into the main shaft 12 via the openings 36 which pivots the second end 22 of each finger 18 toward the main shaft 12 so as to spread the first ends 20 of the fingers 18 apart thereby opening the first grabber. Whenever the trigger 28 is released, the fingers 18, either via the spring loaded attachment of fingers 18 to main shaft 12 (or each other), or spring loaded trigger 28, causes the first ends 20 of the fingers 18 to be brought back together, thereby closing the first grabber. Of course, other mechanisms can be used to actuate the fingers 18 of the first grabber as is well known in the art A secondary shaft 38 also has a proximal end 40 ad a distal end 42 such that the secondary shaft 38 is slidably disposed within the main shaft 12 and such that the proximal end 40 of the secondary shaft 38 extends outwardly from the proximal end 14 of the main shaft 12 and the distal end 42 of the secondary shaft 38 extends outwardly from the distal end 16 of the main shaft 12. A collar 44 is located on the proximal end 14 of the main shaft 12 such that the secondary shaft 38 passes through the collar 44 and such that the collar 44 frictionally engages the secondary shaft 38 so as allow controlled positioning of the secondary shaft 38 with respect to the main shaft 12. A locking pin 46 can be threadably positioned on the collar 44 such that rotation of the locking pin 46 frictionally engages the secondary shaft 38 so as to lock the secondary shaft 38 in position with respect to the main shaft 12 and counterrotating the locking pin 46 causes the locking pin 46 to disengage from the secondary shaft 38 so as to allow the secondary shaft 38 to slide relative to the main shaft 12. The body of the trigger 28 is constructed so as to not interfere with the secondary shaft's position within the main shaft 12, such as by straddling the secondary shaft 38, jogging around the secondary shaft 38, etc.

A cap 48 is located on the proximal end 40 of the secondary shaft 38, which cap 48 acts as a grasping element and as a stop to prevent the secondary shaft 38 from being fully inserted into the main shaft 12 at its proximal end 14. As seen, a series of rings or other visual markings 50 are located on the secondary shaft 38 below the cap 48.

A second grabber 52 is located on the distal end 42 of the secondary shaft 38. The second grabber 52 has a series of evenly spaced apart second fingers 54 having a first end 56 that can grasp and hold a typical golf ball B and a second end 58, these second fingers 54 pivotally attached to the secondary shaft 38 in similar fashion to the attachment of the first fingers 18 to the main shaft 12. These second fingers 54 may also be spring loaded. As seen, a series of second cables 60 are attached to the second end 58 of each second finger 54, one cable 60 per finger 54, with the opposing end of each second cable 60 being attached to a collector ring 62. A pull cable 64, which is a closed loop cable, passes through the collector ring 62 and also passes through an opposing ring or over a pulley 66 located on the opposing side of the secondary shaft 38. As seen, the trigger 28 has a bar 68 that has a pull ring 70 on an end thereof, such that the pull cable 64 passes through the pull ring 70. Whenever the trigger 28 is squeezed, the bar 68 pulls the pull ring 70 diagonally downwardly toward the trigger 28 causing the collector ring 62 to be pulled upwardly into the secondary shaft 38, toward the trigger 28, thereby pulling on the second cables 60 which causes each of the second fingers 54 to pivot to an open position. Release of the trigger 28 allows the pull cable 64 to return to its normal relaxed position and thereby allows the second fingers 54 to close, either under the force of gravity, or if spring-loaded, under the spring load. In this way, the squeezing of the trigger 28 simultaneously opens both the first fingers 18 and the second fingers 54, yet allows the secondary shaft 38 to slide with respect to the main shaft 12 and the trigger 28.

As seen, a clipping system 72 has a main body 74 that encircles the main shaft 12 at a desired point (and may be secured at that point in any desired fashion) with a closed loop clip 76 having a spring loaded openable jaw 78 (which can include carabineer and other similar clips) extending from one side of the main body 74 and a scissors-type clip 80 extending from the opposing side of the main body 78.

As seen in FIG. 1, a pair of support legs 82 is pivotally attachable to the main shaft 12 and capable of folding outwardly therefrom in order to allow the device 10 to be supported on the ground G in tripod fashion.

In order to use the golf ball and tee setting and retrieving device 10 of the present invention, the device 10 is positioned so that the second grabber 52 is overtop a ball B and the first fingers 18 overtop a tee T. The trigger 28 is squeezed so as to open both the fingers first 18 and the second fingers 54. The device 10 is manipulated so that the first fingers 18 pick up the tee T and the second fingers 54 pick up the ball B. The tee T is positioned as desired and pushed into the ground G until the first fingers 18 hit the ground G. As the secondary shaft 38 is set at the desired height with respect to the main shaft 12, the ball B height above the ground G is as desired by the golfer. The trigger 28 is once again squeezed in order to open the first fingers 18 and the second fingers 54 so as to release the first fingers' grip on the tee T, which is secure in the ground G, and the second fingers' grip on the ball B which now rests on the tee T. The markings 50 on the secondary shaft 38 aid the golfer in assuring that the ball B is at the proper height. If the secondary shaft 38 is not needed for the second grabber's retrieval of a ball B and the golfer sets the ball B at the same height irrespective of the shot to be played, then the secondary shaft 38 height with respect to the main shaft 12 is locked in via the locking pin 46.

Once the shot is taken, the tee T is retrieved via the first fingers 18 of the main shaft 12. When the ball B is in a cup, or other pickup location, the second fingers 54 of the secondary shaft 38 are opened and used to retrieve the ball B. As the trigger 28 opens both the first fingers 18 and the second fingers 54, the opening of the first fingers 18 allows the second fingers 54 to be able to retrieve the ball B from the cup. However, if insufficient clearance is available, then the secondary shaft 38 can be slid downwardly with respect to the main shaft 12 in order to achieve the required clearance, the secondary shaft 38 thereafter being returned to its desired position with respect to the main shaft 12 under the aid of the markings 50.

The golf ball and tee setting and retrieving device 10 can be carried in the golfer's bag or on the cart or other appropriate place, or can be clipped to the golfer's pants belt loop via the closed loop clip 76. The scissors clip 80 can secure a golf club so that the golfer, having the device 10 clipped to his or her body via the closed loop clip 76 can clip a desired club, such as a putter to the scissors clip 80. At shot time, the club is released by the scissors clip 80 and the shot taken all the while the device 10 is safely secured to the golfer. Alternately, or in additional, the support legs 82 can hold the device 10 in an upright fashion whenever the golfer is taking a shot. In this way, the golfer can place and retrieve tees T, can place a ball B onto the tee T and retrieve the ball B from the cup (or from the rough, from water, etc.,), hold a club, and otherwise remain upright so that the golfer can play an entire round of golf without the need to ever bend over.

While the invention has been particularly shown and described with reference to an embodiment thereof, it will be appreciated by those skilled in the art that various changes in form and detail may be made without departing from the spirit and scope of the invention.

I claim:

1. A grabbing system comprising:

a hollow main shaft having a first proximal end and a first distal end;

a first grabber having a plurality of first fingers pivotally attached to the main shaft proximate the first distal end;

a clipping system that has a main body that encircles the main shaft, a closed loop clip with a spring loaded jaw extending from a first side of the main body and a scissors clip extending from an opposing second side of the main body;

a secondary shaft slidably disposed within the main shaft, the secondary shaft having a second proximal end extending outwardly from the first proximal end of the main shaft, the secondary shaft also having a second distal end extending outwardly from the first distal end of the main shaft;

a second grabber having a plurality of second fingers pivotally attached to the secondary shaft proximate the second distal end; and a trigger attached to the main shaft, such that the trigger simultaneously opens the first fingers and the second fingers.

2. The grabbing system as in claim 1 further comprising at least one marking located on the secondary shaft proximate the second proximal end.

3. The grabbing system as in claim 2 further comprising a cap located on the second proximal end of the secondary shaft.

4. The grabbing system as in claim 3 further comprising a lock that locks the secondary shaft in a fixed position with respect to the main shaft.

5. The grabbing system as in claim 1 further comprising a pair of support legs pivotally attached to the main shaft.

6. The grabbing system as in claim 5 wherein an end of each first finger is curled and slotted.

7. The grabbing system as in claim 1 further comprising at least one marking located on the secondary shaft proximate the second proximal end.

8. The grabbing system as in claim 1 further comprising a cap located on the second proximal end of the secondary shaft.

9. The grabbing system as in claim 1 further comprising a lock that locks the secondary shaft in a fixed position with respect to the main shaft.

10. The grabbing system as in claim 1 further comprising a clipping system that has a main body that encircles the main shaft, a closed loop clip with a spring loaded jaw extending from a first side of the main body and a scissors clip extending from an opposing second side of the main body.

11. The grabbing system as in claim 1 further comprising a pair of support legs pivotally attached to the main shaft.

12. The grabbing system as in claim 1 wherein an end of each first finger is curled and slotted.

* * * * *